US005372177A

United States Patent [19]

Foster

[11] Patent Number: 5,372,177

[45] Date of Patent: Dec. 13, 1994

[54] METHOD AND APPARATUS FOR REMOVING WAX FROM CASTING MOLD

[76] Inventor: Glenn H. Foster, 17876 Rancho Ave., DeVore, Calif. 92407

[21] Appl. No.: 61,625

[22] Filed: May 13, 1993

[51] Int. Cl.[5] ..... B22C 7/02; B22C 9/04

[52] U.S. Cl. ..... 164/35; 126/343.5 A; 164/66.1; 164/401

[58] Field of Search ..... 164/34, 35, 36, 44, 164/66.1, 24, 516, 401; 126/343.5 R, 343.5 A

[56] References Cited

U.S. PATENT DOCUMENTS

| | | | |
|---|---|---|---|
| 1,291,588 | 1/1919 | Maves | 164/35 |
| 1,526,615 | 2/1925 | Stowell et al. | 126/343.5 A X |
| 1,596,214 | 8/1926 | O'Brien | 126/343.5 A X |
| 2,463,193 | 3/1949 | McFadden | 164/35 |
| 2,496,170 | 1/1950 | Mann | 164/35 |
| 2,518,040 | 8/1950 | Mann . | |
| 3,132,388 | 5/1964 | Grant | 164/36 |
| 3,222,738 | 12/1965 | Carter | 164/34 |
| 3,259,949 | 7/1966 | Moore | 164/34 |
| 3,519,057 | 7/1970 | Benson et al. | 164/35 |
| 4,213,495 | 7/1980 | Rose | 164/34 |

FOREIGN PATENT DOCUMENTS

| | | | |
|---|---|---|---|
| 4-91846 | 3/1992 | Japan | 164/35 |
| 839910 | 6/1960 | United Kingdom | 164/35 |
| 804180 | 2/1981 | U.S.S.R. | 164/44 |
| 1014626 | 4/1983 | U.S.S.R. | 164/44 |

*Primary Examiner*—J. Reed Batten, Jr.
*Attorney, Agent, or Firm*—Denton L. Anderson

[57] ABSTRACT

A method and an apparatus are provided which allows the safe and inexpensive extinguishing and cooling of flaming wax emanating from an investment casting flash fire dewaxing furnace. Investment mold structures are disposed within individual cups which direct flaming wax material downwardly through individual openings in the furnace floor. Flaming wax is then extinguished within an extinguishing chamber by a stream of non-aqueous inert gas. The process makes flash fire dewaxing of investment mold structures efficient and safe and provides for easy recycling and reuse of the wax because it is not contaminated with water or other contaminant materials.

17 Claims, 3 Drawing Sheets

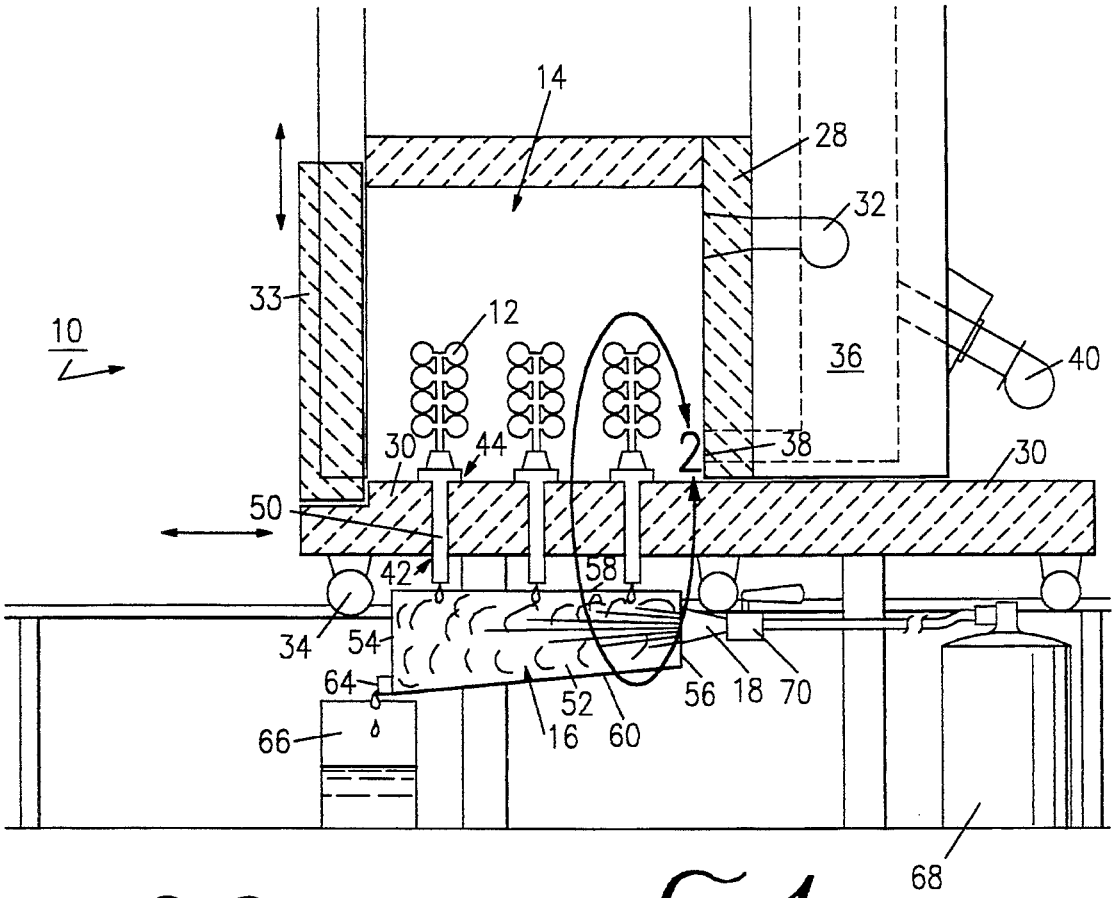
FIG. 1
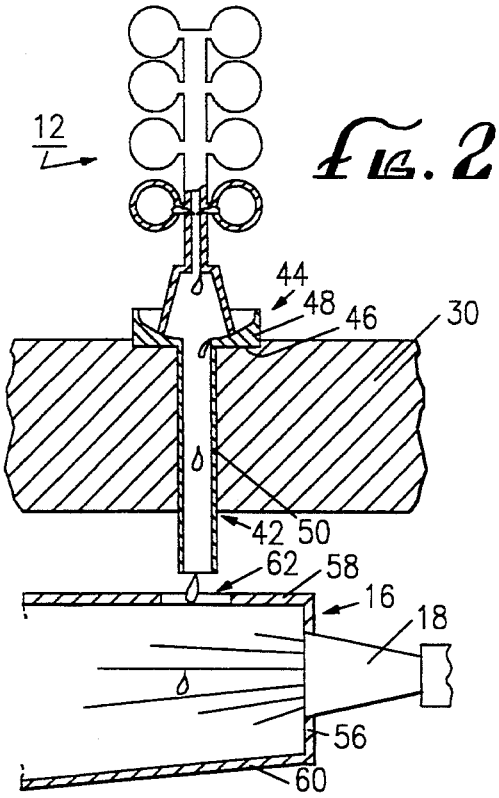
FIG. 2
FIG. 5
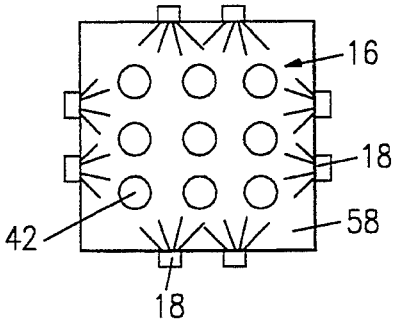
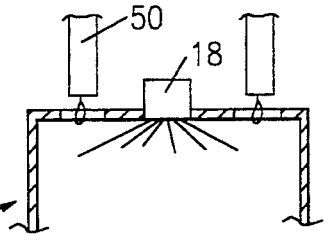
FIG. 6

METHOD AND APPARATUS FOR REMOVING WAX FROM CASTING MOLD

FIELD OF THE INVENTION

The invention is directed generally to the field of investment casting and, specifically, to methods and apparatus for removing wax from an investment casting mold.

BACKGROUND OF THE INVENTION

Investment casting is a process for casting precision metal "parts," such as jewelry components, denture components and precision machinery parts.

In an investment casting process, patterns or models formed of a special wax (or resin or like material) are embedded in a refractory investment mold, usually by dip-coating the wax pattern several times in a liquid suspension of a fine-grained refractory. After the refractory dries, the wax is removed, leaving a thin-walled refractory shell for use as a ceramic mold for the metallic parts.

In preparing the ceramic molds, it is common to dip-coat several individual wax patterns at one time. Each of the patterns is attached to a vertical wax support member and the resulting assemblage is repeatedly dip-coated. After dip-coating, a single investment mold structure is created, made up of several individual mold units. The investment mold structure has a nearly continuous ceramic exterior with a single sprue opening in its base. The interior of this structure is waxed-filled with the wax patterns disposed within the contours of the individual molds. A cross-sectional view of a typical investment mold structure is shown in FIG. 7.

After this investment mold structure is created, the wax must be removed from the interior of the structure. Preferably the wax is recovered, treated to remove process impurities and then reused to make new patterns.

Removing the wax from the interior of the mold structure is generally accomplished by heating the mold structure and allowing the molten wax to flow out of the structure through the sprue opening. The mold structure must be heated rapidly. If the mold structure is heated slowly, the more rapidly expanding wax will crack the less rapidly expanding ceramic shell.

In most of the older investment cast processes, the mold structure is heated in a high pressure autoclave. However, the recovered wax from an autoclave-heated unit is mixed with the autoclave steam condensate, making recovery and treatment of the wax difficult and expensive. Furthermore, heating the mold structure in an autoclave does not always accomplish the removal of all of the wax as quickly and as completely as frequently desired. Still further, high pressure autoclaves are expensive to purchase, complex to maintain and relatively dangerous to operate.

To avoid these problems, mold structures are increasingly being dewaxed by a "flash fire" dewaxing process. In such a process, the investment mold structure is rapidly heated to a temperature in excess of 1000° F. in a convection furnace. The wax is thereby rapidly and completely driven from the mold structure. Problems, however, remain with respect to recovering the wax. At the high temperature and oxygen-rich environment present within the flash fire furnace, the wax tends to exit the sprue hole in a flaming state. The flaming wax must be quickly and safely quenched before the wax can be recycled. In a typical prior art quenching method, the flaming wax is allowed to drop through a grating in the furnace floor and is extinguished in a water bath. However, this again introduces water into the recovered wax, making it difficult and expensive to purify the wax for reuse.

Accordingly, there is a need for an extinguishing method and apparatus usable in the flash fire dewaxing process which is inexpensive, safe and simple to use, but which does not use a water quench or other method which would make difficult the purification and reuse of the recovered wax.

SUMMARY OF THE INVENTION

The invention satisfies this need. The invention is a flash fired furnace useful for dewaxing an investment casting ceramic mold structure, the furnace comprising: (a) a heatable furnace chamber having a furnace floor with at least one furnace floor opening; (b) an extinguishing chamber disposed below the furnace chamber so that, when an investment casting mold is placed over the furnace floor opening and is then heated, melted wax dripping out of the bottom mold opening flows into the extinguishing chamber via the furnace floor opening; and (c) a gas injector for injecting an inert non-aqueous gas into the extinguishing chamber so as to extinguish and cool any flaming wax which drips into the extinguishing chamber.

In a typical embodiment, the furnace comprises a plurality of furnace floor openings so that a plurality of investment casting ceramic mold structures can be dewaxed at once.

In a preferred embodiment, each of the furnace floor openings has a cup structure disposed therein. Each cup structure has a base, side walls and a drain tube. Each cup structure is dimensioned to accept an investment casting mold at its bottom sprue opening so that wax dripping from the mold structure is directed out of the furnace chamber and into the extinguishing chamber via the drain tube of the cup.

In a typical embodiment, the non-aqueous inert gas is carbon dioxide. Nitrogen or some other inexpensive inert gas can also be used.

Also in a typical embodiment, the extinguishing chamber comprises a plurality of gas injectors. The injectors can be disposed at any angle calculated to quickly and efficiently extinguish and cool flaming wax dripping in from the furnace chamber. A plurality of injectors can be disposed in horizontal planes to inject inert gas across the path of dropping wax.

The invention provides a simple, inexpensive and safe method of extinguishing flaming wax from a flash fire dewaxing process.

DESCRIPTION OF THE DRAWINGS

These and other features, aspects, and advantages of the present invention will become better understood with reference to the following description, appended claims, and accompanying drawings wherein:

FIG. 1 is a side view in partial cross-section of a flash fire furnace having features of the invention;

FIG. 2 is a detailed view in partial cross-section of a furnace floor opening and cup useable in the flash fire furnace of FIG. 1;

FIG. 5 is a top view of an extinguishing chamber useful in the invention;

FIG. 6 is a side view in partial cross-section of an extinguishing chamber having a downwardly directed gas injector.

DESCRIPTION OF THE INVENTION

Figure 3:
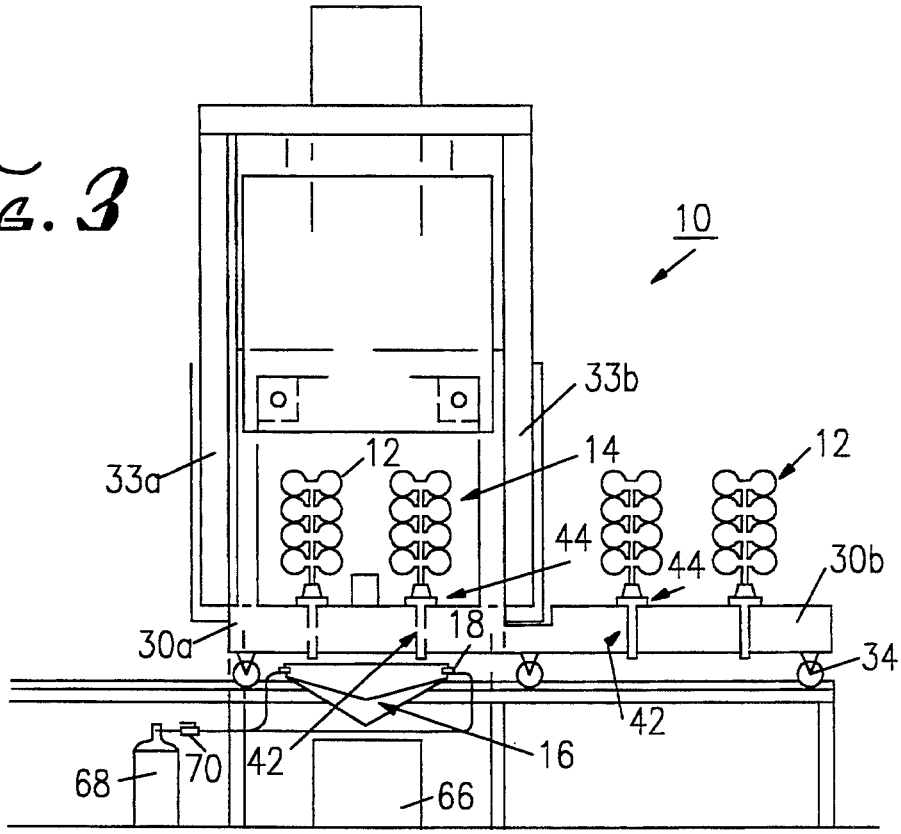
FIG. 3 is a side view of a second flash fire furnace having features of the invention.

The invention is a flash fire furnace 10 useful for dewaxing an investment casting ceramic mold structure 12. In its simplest form, the invention comprises a heatable furnace chamber 14, an extinguishing chamber 16 and one or more gas injectors 18. The invention is useful in flash fire dewaxing a ceramic investment casting mold structure 12.

Figure 7:
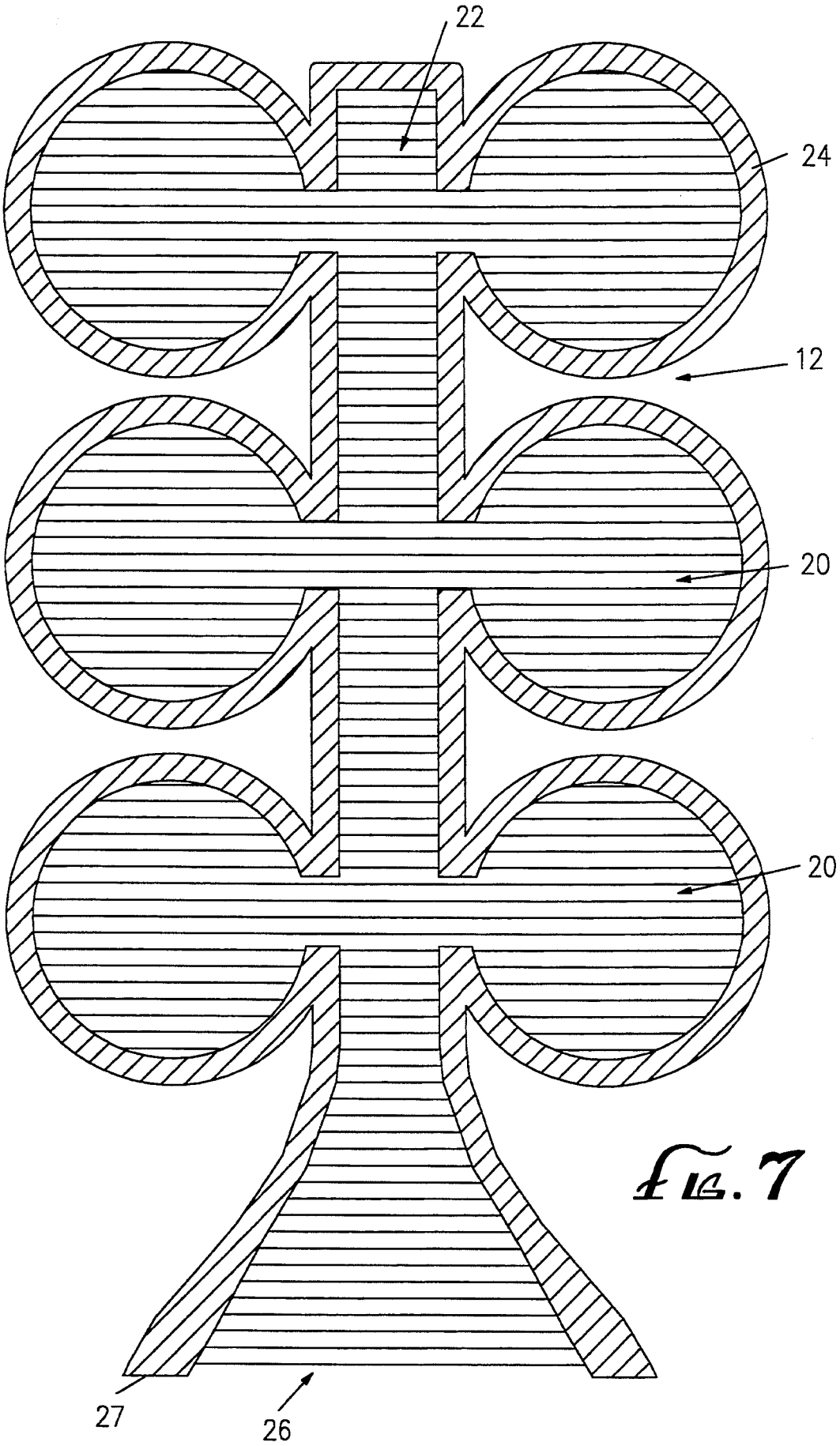
FIG. 7 is a cross-section of a typical investment casting mold structure useable in the invention.

A typical investment casting mold structure 12 is shown in FIG. 7. Six individual mold units 20 are attached to a vertical wax support member 22. After dip-coating, the support member 22 and mold units 20 are surrounded by a layer of ceramic 24. A sprue hole 26 is defined in the base 27 of the structure 12.

The heatable furnace chamber 14 is a typical heatable furnace chamber having heat resistant walls 28, floor 30 and a source of heat energy. In a typical embodiment, the walls 28 and the floor 30 of the furnace 14 are constructed of steel which is heat protected by appropriate thicknesses of refractory. In a typical embodiment, the source of heat energy is one or more gas fired primary burners 32 mounted into the side walls 28 of the furnace chamber 14.

The furnace chamber 14 shown in FIG. 1 has a door 33 which slides up and down and the furnace floor 30 rolls left and right on wheels 34. This configuration allows the removal of processed mold structures 12 and the installation of unprocessed mold structures 12 outside of the furnace chamber 14 so that the furnace chamber 14 can be continuously maintained at processing temperatures.

The furnace 14 also has a flue duct 36 which removes smoke and other combustion products from the furnace chamber 14. Preferably, the primary burners 32 fire horizontally from an upper corner of one of the horizontal walls 28 of the furnace chamber 14 and a flue duct opening 38 is located in the center bottom of the same furnace chamber wall 28. By this configuration, a circular heating pattern is generated within the furnace chamber 14.

Disposed within the flue duct 36 can be an afterburner 40. During operation, the afterburner 40 acts to totally combust smoke, soot and other carbonaceous materials in the flue duct 36 so as to yield a non-polluting exhaust effluent.

The furnace floor 30 has one or more furnace floor openings 42. Typically, each furnace floor opening 42 is circular and has a diameter between about 1.0 and about 6.0 inches. In the embodiment shown in FIG. 5, the furnace floor 30 has nine openings 42 arranged in a 3×3 array. Multiple furnace floor openings 42 allow the processing of multiple investment casting mold structures 12, thereby increasing productivity.

Preferably, each furnace floor opening 42 has disposed within it a cup structure 44. Each cup structure 44 has a base 46, side walls 48 and a hollow drain tube 50. Most preferably, the drain tube 50 is dimensioned to fit snugly within the furnace floor opening 42 to minimize gaseous communication between the furnace chamber 14 and the region below the furnace floor 30. Also, it is preferable (for the same reason) for each cup structure 44 to effectively cover a furnace floor opening 42.

The base 46 and the side walls 48 of the cud structure 44 are dimensioned to receive and retain the base 27 of the investment casting mold structure 12 in such a way that the bottom sprue hole 26 of the mold structure 12 is disposed immediately above the drain tube 50.

The cup structure 44 is constructed of any suitable material which can withstand the high heat generated in the furnace chamber 14 and by the drips of flaming wax material.

The extinguishing chamber 16 is a substantially enclosed structure made of material calculated to mechanically and chemically withstand the high temperatures of the dripping flammable wax.

As shown in FIGS. 1 and 6, the extinguishing chamber 16 can be a simple box having two side walls 52, a first end wall 54, a second end wall 56, a top wall 58 and a bottom wall 60. Preferably, the bottom wall 60 slopes downwardly. In the embodiment shown in FIG. 1, the extinguishing chamber 16 has an opening 62 in the top wall 58 directly below each of the furnace floor openings 42. In this configuration, wax dripping through each furnace floor opening 42 gravitates directly into the extinguishing chamber 16.

The extinguishing chamber 16 also comprises an outlet 64 opening, typically in the first end wall 54 at the base of the sloping bottom wall 60. As shown in FIG. 1, a wax catch drum 66 is used to recover the extinguished and cooled wax.

In the embodiment shown in FIG. 1, a gas injector 18 is disposed in the second end wall 56 of the extinguishing chamber 16. The gas injector 18 is in fluid communication with a source of non-aqueous inert gas, represented in FIG. 1 by a gas canister 68. A valve 70 is used to control the flow of gas from the canister 68 to the gas injector 18.

In the embodiment shown in FIG. 1, a single gas injector 18 is used. Other configurations can also be used. In FIG. 5, an eight injector configuration is shown. Several pairs of gas injectors 18 are disposed in a horizontal plane so as to direct a gas stream perpendicular to the dripping wax. Each pair of injectors 18 is disposed so that their respective gas streams flow into the extinguishing chamber 16 at 90° with respect to one another. Each pair of gas injectors 18 has a corresponding, oppositely-directed pair of gas injectors 18 injecting gas into the extinguishing chamber 16 at an angle of about 180° from the gas injected by the first pair.

As shown in FIG. 6, downwardly directed gas injectors 18, disposed in a vertical plane can also be used where deemed appropriate.

Any suitable inert, non-aqueous gas can be used in the invention. In a typical embodiment, the inert gas is carbon dioxide. Nitrogen can also be used, as can many other inert gases. The gas should be non-aqueous, that is, it should not comprise steam. The gas should also comprise no other material which would form a condensate at operating temperatures which would mix with the cooled and extinguished wax and be difficult to separate from the wax. Also, the gas should not be reactive to the wax or to the materials of construction of the furnace chamber 14, extinguishing chamber 16 or gas injectors 18.

Figure 4:
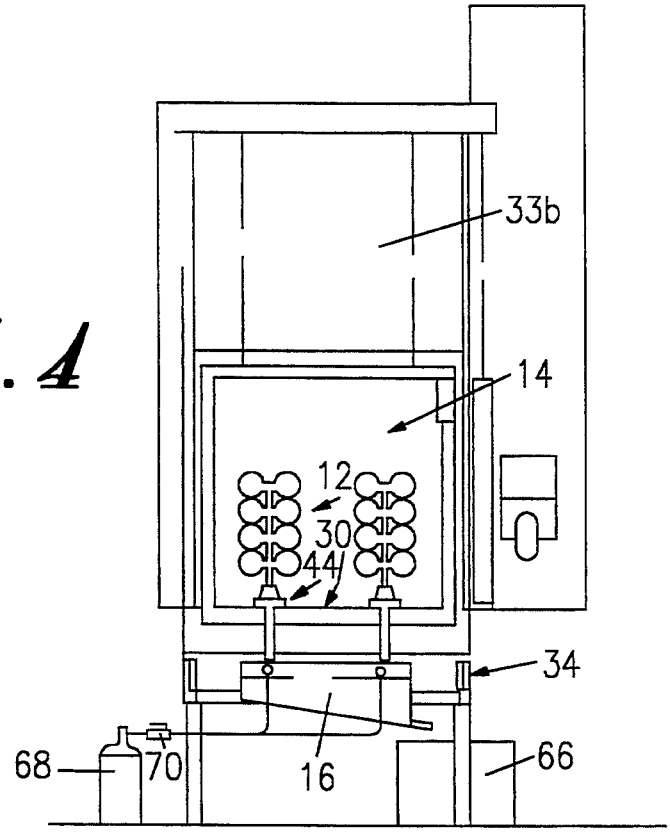
FIG. 4 is an end view of the flash fire furnace of FIG. 3.

In the embodiments shown in FIGS. 3 and 4, the furnace chamber 14 has two vertically sliding doors 33*a* and 33*b*, and the furnace chamber 14 has two identical furnace floors 30*a* and 30*b*, both having a set of furnace floor openings 42. In this embodiment, one furnace floor 30*a* or 30*b* can be being unloaded and reloaded with mold structures 12 while mold structures 12 disposed on the other furnace floor 30 are being dewaxed. The double furnace floor 30 slides back and forth on wheels 34.

In operation, the furnace floor openings 42 are disposed outside of the furnace chamber 14 by opening the furnace door 33 and rolling the floor 30 using the wheels 34. An investment casting mold structure 12 is disposed within each of the cup structures 44 within the furnace floor openings 42. The furnace chamber 14 is preheated to a temperature between about 1400° F. and about 1600° F. The extinguishing chamber 16 is purged for about ten seconds with inert gas. The furnace door 33 is opened, the mold structures 12 are moved into the furnace chamber 14 and the furnace door 33 is closed.

A light spray of carbon dioxide is initiated within the extinguishing chamber 16 via the gas injector 18. As the mold structures 12 are heated, wax begins to melt and drip out of each structure 12, into the drain tube 50 and into the extinguishing chamber 16. Much of the dripping wax is aflame. Complete dewaxing usually takes between about seven and about ten minutes.

As the flaming wax drips into the extinguishing chamber 16, it is quickly extinguished by the flow of inert gas which purges the extinguishing chamber 16 of all oxygen.

After the last of the wax is dripped through the drain tubes 50, any residual wax in the mold structure is burned away by additional heating of the mold structures 12. Thereafter, the mold structure shells are removed from the furnace chamber 14 by opening the furnace door 33, moving that portion of the furnace floor 30 having the shells outside of the furnace chamber 14 using the wheels 34, and then reclosing the furnace door 33. The shells are allowed to cool and the cycle can be repeated.

The foregoing describes in detail several preferred embodiments of the invention. The foregoing should not be construed, however, as limiting the invention to the particular embodiments describes. Practitioners skilled in the art will recognize numerous other embodiments as well. For a definition of the complete scope of the invention, the reader is directed to the appended claims.

What is claimed is:

1. A flash fire furnace useful for dewaxing an investment casting ceramic mold structure, wherein the investment casting mold structure comprises a wax-filled hollow body with a bottom opening, the furnace comprising:

(a) a heatable furnace chamber having a furnace floor with at least one furnace floor opening;

(b) an extinguishing chamber disposed below the furnace chamber so that, when the investment casting mold structure is placed over the furnace floor opening and is then heated, melted wax dripping out of the bottom mold opening flows into the extinguishing chamber via the furnace floor opening; and (c) a gas injector for injecting an inert non-aqueous gas into the extinguishing chamber so as to extinguish and cool any flaming wax which drips into the extinguishing chamber.

2. The flash fire furnace of claim 1, wherein the furnace floor opening is dimensioned so that a ceramic mold structure disposed above the furnace floor opening completely surrounds the furnace floor opening.

3. The flash fire furnace of claim 2 further comprising a cup, the cup having a base, side walls and a drain tube, the drain tube being disposed within the furnace floor opening.

4. The flash fire furnace of claim 1 comprising a plurality of furnace floor openings.

5. The flash fire furnace of claim 1, wherein the gas injector is directed downwardly.

6. The flash fire furnace of claim 1 wherein the number of gas injectors for injecting an inert non-aqueous gas into the extinguishing chamber is greater than one.

7. The flash fire furnace of claim 1, wherein the gas injector is disposed in a horizontal plane.

8. The flash fire furnace of claim 1, wherein the number of gas injectors for injecting an inert non-aqueous gas into the extinguishing chamber is two and wherein the gas injectors are each disposed in horizontal planes and are disposed within the extinguishing chamber in such a way that inert non-aqueous gas injected from one of the gas injectors enters the extinguishing chamber at an angle greater than 90° with respect to the inert gas injected from the other gas injector.

9. The flash fire furnace of claim 1, wherein the number of gas injectors for injecting an inert non-aqueous gas into the extinguishing chamber is two and wherein the gas injectors are each disposed in horizontal planes and are disposed within the extinguishing chamber in such a way that inert non-aqueous gas injected from one of the gas injectors enters the extinguishing chamber at an angle greater than 180° with respect to the inert gas injected from the other gas injector.

10. The flash fire furnace of claim 1 wherein the number of gas injectors for injecting an inert non-aqueous gas into the extinguishing chamber is four and wherein the four gas injectors are disposed in two opposing pairs, both disposed in horizontal planes.

11. The flash fire furnace of claim 1 having two furnace floors, each furnace floor being movable from a first position wherein the furnace floor is disposed above the extinguishing chamber and a second position wherein the furnace floor is not disposed above the extinguishing chamber.

12. The flash fire furnace of claim 11 wherein the two furnace floors are mounted on wheels.

13. A flash fire furnace useful for dewaxing an investment casting ceramic mold structure, wherein the investment casting mold structure comprises a wax-filled hollow body with a bottom opening, the furnace comprising:

(a) a heatable furnace chamber having a furnace floor and a plurality of furnace floor openings;

(b) a cup disposed within each furnace floor opening, each cup having a base, side walls and a drain tube;

(c) an extinguishing chamber disposed below the furnace chamber so that, when the investment casting mold structure is placed in the cup and is then heated, melted wax dripping out of the bottom mold opening flows into the extinguishing chamber via the drain tube; and (d) a gas injector for injecting an inert non-aqueous gas into the extinguishing chamber so as to extinguish and cool any flaming wax which drips into the extinguishing chamber.

14. The flash fire furnace of claim 13 having a plurality of gas injectors for injecting inert gas into the extinguishing chamber.

15. A method for the flash fire dewaxing of a ceramic mold structure having wax filled hollow body with a bottom opening comprising the steps of:

(a) placing the mold structure in a furnace chamber having a furnace floor opening, the bottom opening of the mold structure being disposed immediately above the furnace floor opening;

(b) heating the mold structure to a temperature in excess of 1000° F., whereby wax within the mold structure liquifies and is set afire and drips out of the mold structure through the bottom opening, through the furnace floor opening and into an extinguishing chamber; and (c) extinguishing and cooling the flaming wax by contacting the wax with an injected stream of a non-aqueous inert gas.

16. The method of claim 15, wherein the inert gas is carbon dioxide.

17. The method of claim 15, wherein the inert gas is nitrogen.

* * * * *